US006029585A

United States Patent [19]

Tabayashi

[11] Patent Number: 6,029,585

[45] Date of Patent: Feb. 29, 2000

[54] LIFT MECHANISM

[75] Inventor: Yoshikazu Tabayashi, Suita, Japan

[73] Assignee: Osaka Taiyu Co., Ltd., Osaka, Japan

[21] Appl. No.: 08/941,134

[22] Filed: Sep. 30, 1997

[30] Foreign Application Priority Data

May 15, 1997 [JP] Japan ..... 9-125383

[51] Int. Cl.[7] ..... A47B 9/00

[52] U.S. Cl. ..... 108/145; 108/147

[58] Field of Search ..... 108/145, 147, 108/7, 9; 248/188.2, 188.1, 404

[56] References Cited

U.S. PATENT DOCUMENTS

| | | | |
|---|---|---|---|
| 2,766,007 | 10/1956 | Krilanovich | 108/147 X |
| 3,302,971 | 2/1967 | Lory | 108/145 X |
| 4,073,240 | 2/1978 | Fly | 8/145 X |
| 4,593,874 | 6/1986 | Dunagan | 108/147 X |
| 4,817,220 | 4/1989 | Guttormsem | 108/145 X |
| 5,005,492 | 4/1991 | Ogino et al. | 108/145 |
| 5,687,755 | 11/1997 | Weinschenk, Jr. et al. | 108/147 |

FOREIGN PATENT DOCUMENTS

| | | | |
|---|---|---|---|
| 1053331 | 3/1959 | Germany | 108/145 |

*Primary Examiner*—Jose V. Chen

*Attorney, Agent, or Firm*—Arnold B. Silverman; Michael D. Lazzara; Eckert Seamans Cherin & Mellott, LLC

[57] ABSTRACT

A lift mechanism is provided with a lower bracket to be attached to a base, a lower support arm and a lower drive arm each pivoted at one end thereof to the lower bracket, an intermediate bracket for pivotally supporting free ends of the two arms at respective positions at equal distances from the pivoted positions of the arms on the lower bracket with the arms in parallel to each other, a lift control apparatus disposed on the intermediate bracket and having a movable member retractably projectable in a direction parallel to the base, an upper support arm and an upper drive arm pivoted each at one end thereof to the intermediate bracket at respective positions symmetric with the pivoted positions of the lower support and drive arms with respect to the lift control apparatus, an upper bracket for pivotally supporting the other ends of the upper support arm and the upper drive arm, and a pair of traction members attached each at one end thereof to an outer end of the movable member of the lift control apparatus and connected at the other ends thereof to respective mount portions formed on the lower drive arm and the upper drive arm at their ends pivoted to the intermediate bracket.

9 Claims, 17 Drawing Sheets

LIFT MECHANISM

FIELD OF THE INVENTION

The present invention relates to lift mechanisms for lifting and lowering a table.

BACKGROUND OF THE INVENTION

The present applicant has previously proposed a lift device for lifting and lowering a table by a hydraulic cylinder unit (Examined Japanese Utility Model Publication No. 6875/1983). FIG. 8 shows the proposed device 9, which has a pair of intersecting arms 93, 94 pivoted to each other at their midportions and arranged between the upper surface of a base 92 and the lower surface of a table 91 at each of the right and left sides of the device. The arms 93, 94 have base ends pivoted to the base 92 and the table 91, respectively. A roller 95 is rotatably attached to the other end of each arm. The rollers 95, 95 are rollable on rails 96, 96 provided on the upper surface of the base 92 and the lower surface of the table 91. The arms 93, 93 pivoted to the base 92 are interconnected by a connecting rod 89 and links 88. A hydraulic cylinder unit 97 has a piston rod 98 connected to the midportion of the connecting rod 89. The unit 97 has a cylinder 99 fixed to the base 92.

When hydraulic oil is supplied to the cylinder unit 97, the piston rod 98 moves up, pushing up the connecting rod 89. With the upward movement of the connecting rod 89, the intersecting arms 93, 94 connected by the links 88 to the rod 89 are raised with the rollers 95, 95 rolling on the rails 96, 96 toward the base-end side to lift the table 91 while holding the table 91 in parallel to the base 92.

The hydraulic oil is discharged from the cylinder unit 97 to lower the lifted table 91. This releases the arms 93, 94 from the pressure of the cylinder unit 97, permitting the arms 93, 94 to move toward a falling direction under gravity acting on the table 91 or by being pulled by the downward stroke of the piston rod 98, with the result that the table 91 descends while remaining parallel to the base 92.

With the table lift device 9 of the above construction, the raised level of the table 91 is limited by the length of the intersecting arms 93, 94.

Such a device is usually so designed that the arms 93, 94 are stowed under the table 91 so as not to project outward beyond the table 91. In order to elevate the highest raised level of the table 91, therefore, there arises a need to link pairs of intersecting arms 93, 94 one above another in a pantographic manner.

The intersecting arms 93,94 are raised through an approximately definite angle by a single projecting stroke of the piston rod 98 when the hydraulic oil is supplied to the cylinder unit 97.

The roller 91 bearing against the table 91 moves along a circular-arc path during the ascent of the table 91, so that as the arms 93, 94 approach from the position wherein they are parallel to the base 92 to a position perpendicular to the base, the rate of rise of the arms gradually decreases. For this reason, the amount of projection of the cylinder unit piston rod 98 is not in proportion to the amount of ascent of the table 91, and it is difficult to control the rate of ascent of the table 91.

An object of the present invention is to provide a lift mechanism which is adapted to lift the table at a higher level and to render the table movable upward and downward at a constant rate.

SUMMARY OF THE INVENTION

The present invention provides a lift mechanism which comprises a lower bracket to be attached to a base; a lower support arm pivoted at one end thereof to the lower bracket, and a lower drive arm pivoted at one end thereof to the lower bracket at a position obliquely downward from the pivoted position of the support arm; an intermediate bracket for pivotally supporting free ends of the support arm and the drive arm at respective positions at equal distances from the pivoted positions of the arms on the lower bracket with the arms in parallel to each other, lift control means disposed on the intermediate bracket and having a movable member retractably projectable in a direction parallel to the base, an upper support arm and an upper drive arm pivoted each at one end thereof to the intermediate bracket at respective positions symmetric with the pivoted positions of the lower support and drive arms with respect to the lift control means; an upper bracket for pivotally supporting the other ends of the upper support arm and the upper drive arm at respective positions at equal distances from the pivoted positions of the upper arms on the intermediate bracket with the upper arms in parallel to each other; and a pair of traction members attached each at one end thereof to an outer end of the movable member of the lift control means and connected at the other ends thereof to respective mount portions formed on the lower drive arm and the upper drive arm at their ends pivoted to the intermediate bracket.

When a table is mounted on the upper bracket with the lower bracket attached to the base, the lift mechanism of the invention provides a device for lifting the table.

Further when a pair of lift mechanisms having the foregoing construction of the invention are mounted on a base with a table attached to the top portions of the upper brackets of the lift mechanisms, a device is available which is adapted to lift or lower the table in parallel to the base and to tilt the table.

DETAILED DESCRIPTION OF THE INVENTION

The present invention will be described below in detail with reference to the drawings.

First Embodiment

[Construction]

Figure 1:
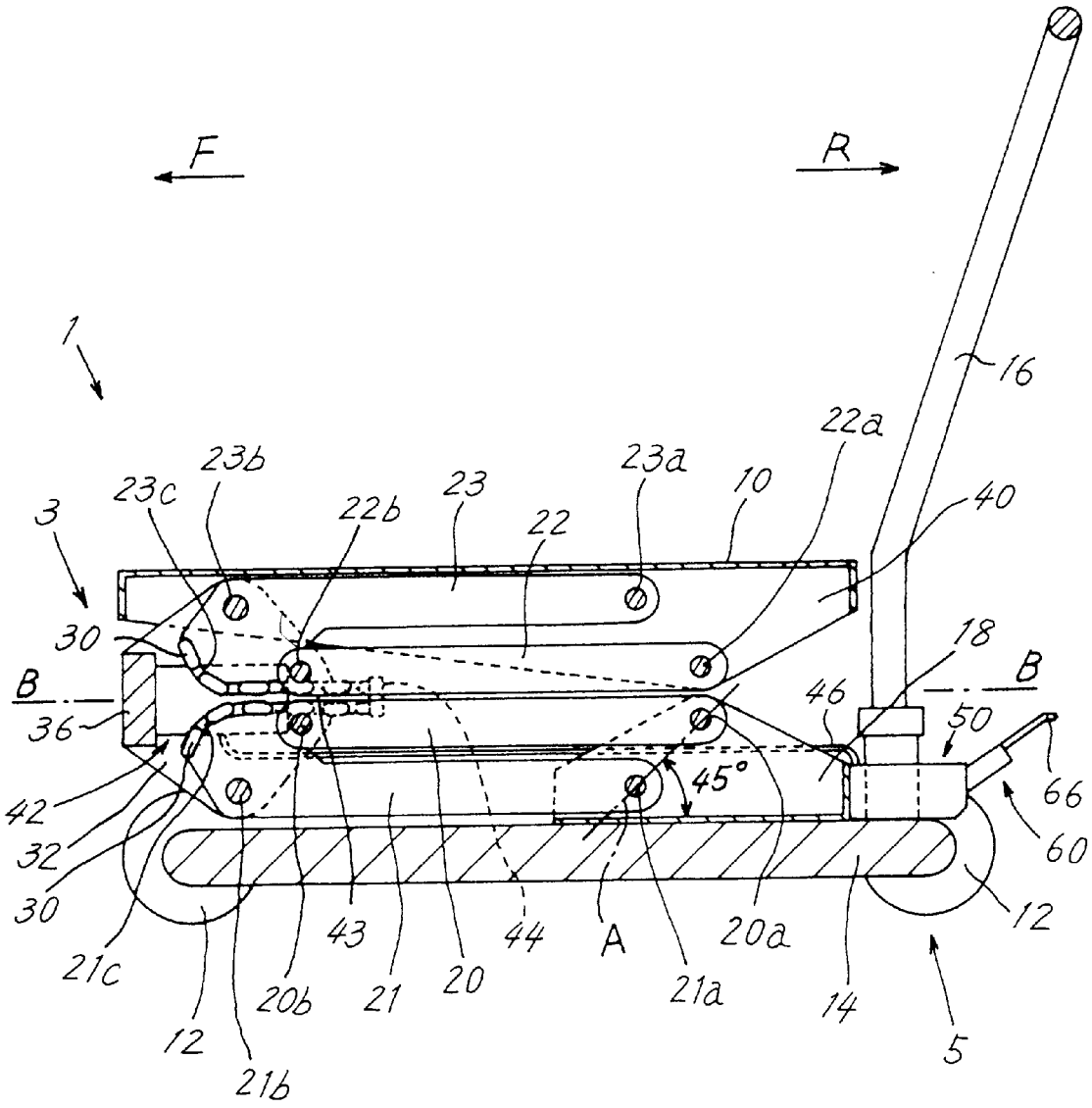
FIG. 1 is a sectional view of a lift mechanism of the invention as low.
Figure 2:
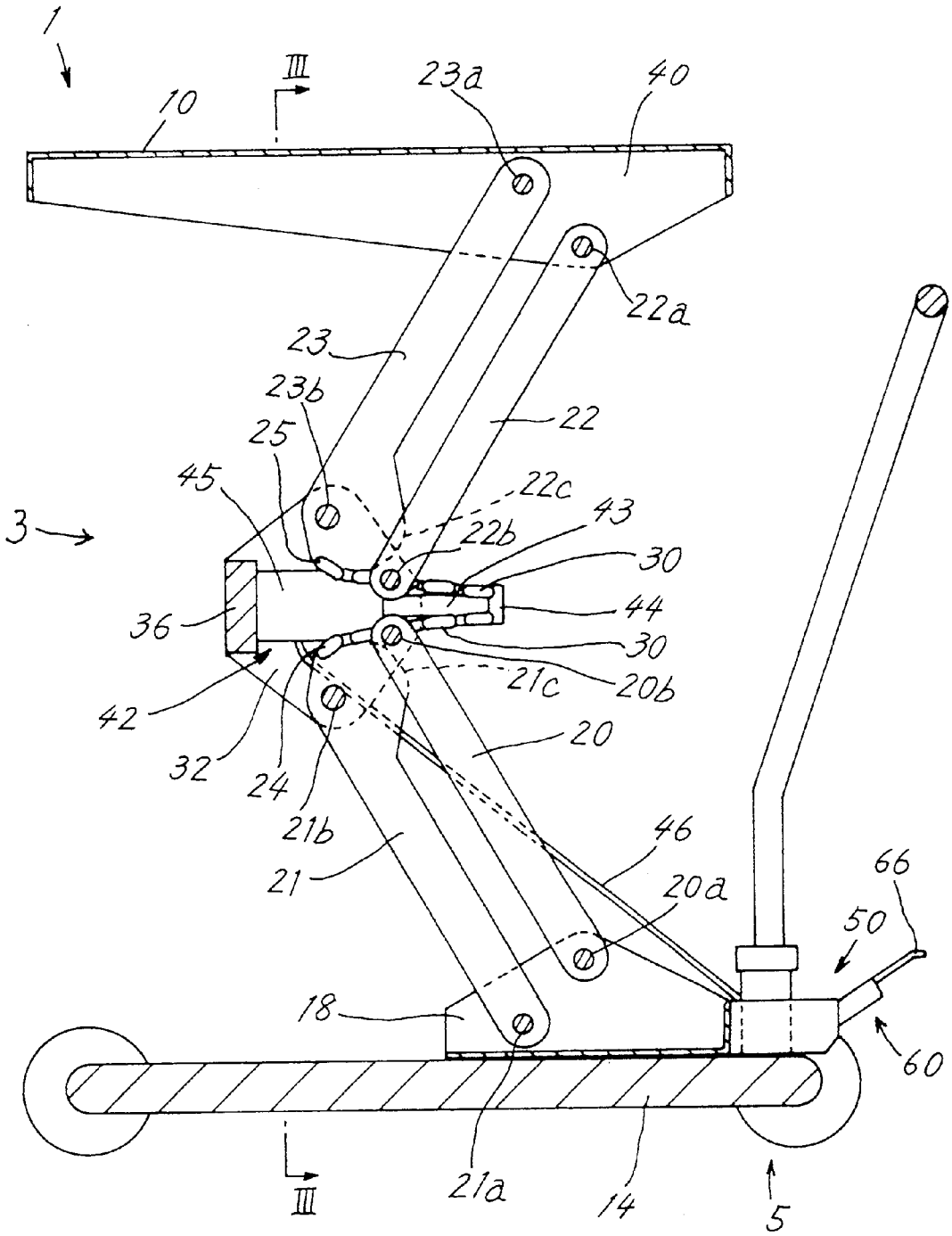
FIG. 2 is a sectional view of the lift mechanism of the invention as lifted.
Figure 3:
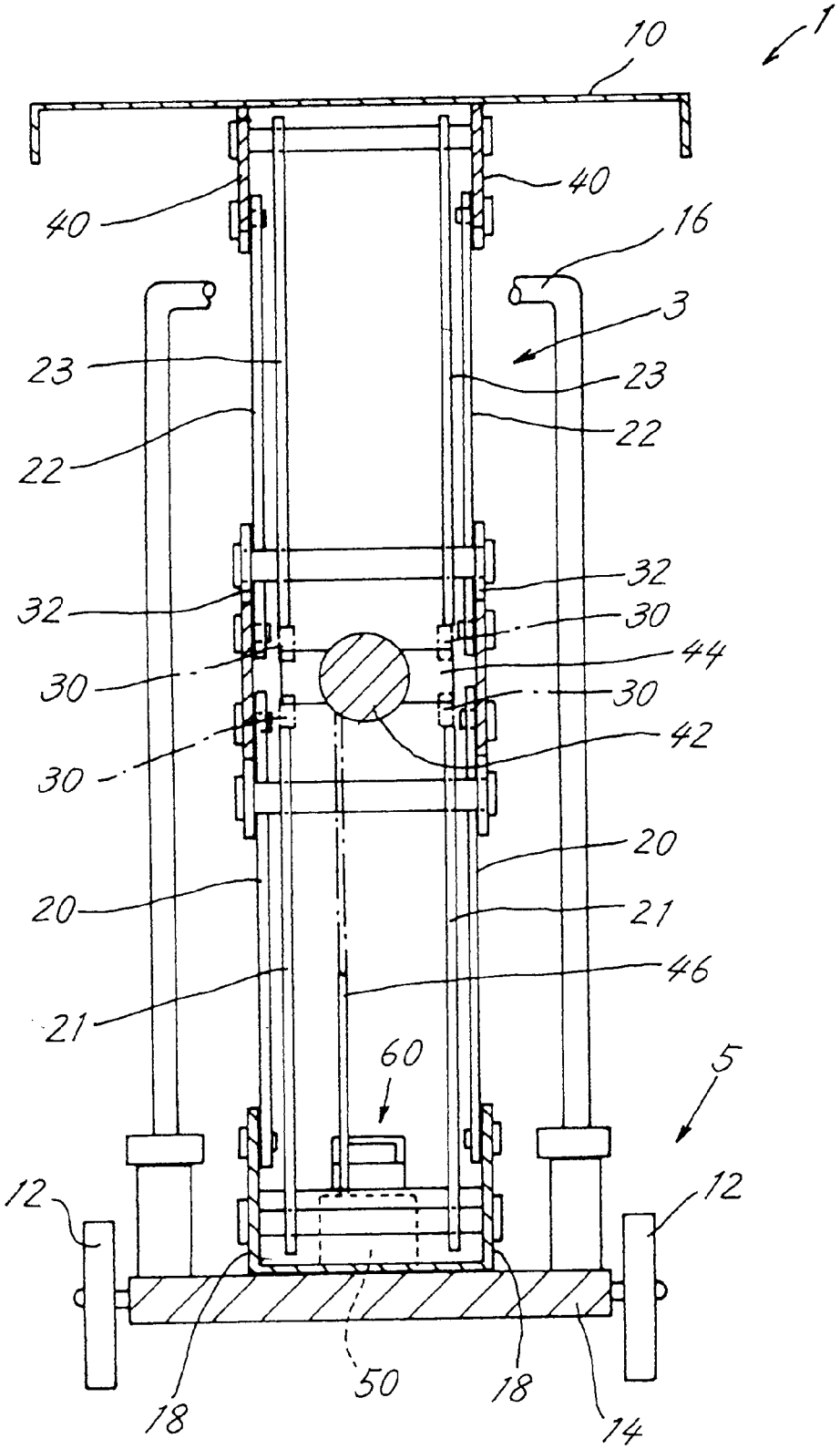
FIG. 3 is a view in section taken along the line III—III in FIG. 2.

With reference to FIGS. 1 to 3, an embodiment will be described which comprises a table lift device 1 mounted on a pushcart 5. The lift device 1 comprises a lift mechanism 3 of the invention and a table 10 attached to the mechanism. The pushcart 5 comprises a base 14 rotatable carrying a wheel 12 at each of its four corners, and a handle 16 attached to the rear end of the base 14.

FIG. 1 is a sectional view of the device 1 with the table lowered, FIG. 2 is a sectional view of the same with the table lifted, and FIG. 3 is a view in section taken along the line III—III in FIG. 2.

In the following description of the present embodiment, the term "front" refers to the direction of advance of the pushcart 5 indicated by the arrow F in FIG. 2, and the term "rear" to the opposite direction indicated by the arrow R.

The lift mechanism 3 of the invention has the following construction. Lower brackets 18, 18 are provided upright on the base 14 respectively at opposite side portions thereof toward the handle 16 in parallel to each other in the front-rear direction. A lower drive arm 21 and a lower support arm 20 are movably attached by respective first pivots 21*a*, 20*a* to each of the lower brackets 18, 18 on the inner side thereof. Preferably a phantom line A through-the two first pivots 21*a*, 20*a* makes an angle of 45 degree with the base 14 as seen in FIG. 1.

Thus, one pair of lower support arm 20 and lower drive arm 21 is provided on each lower bracket 18. Similarly one pair of upper support arm 22 and upper drive arm 23 is provided at each of right and left sides as will be described later.

With reference to FIGS. 1 and 2, the lower drive arm 21 has a free end formed with a cam face 21*c* for a traction member 30 to bear on as will be described later. For example, a chain is used as the traction member.

Figure 4:
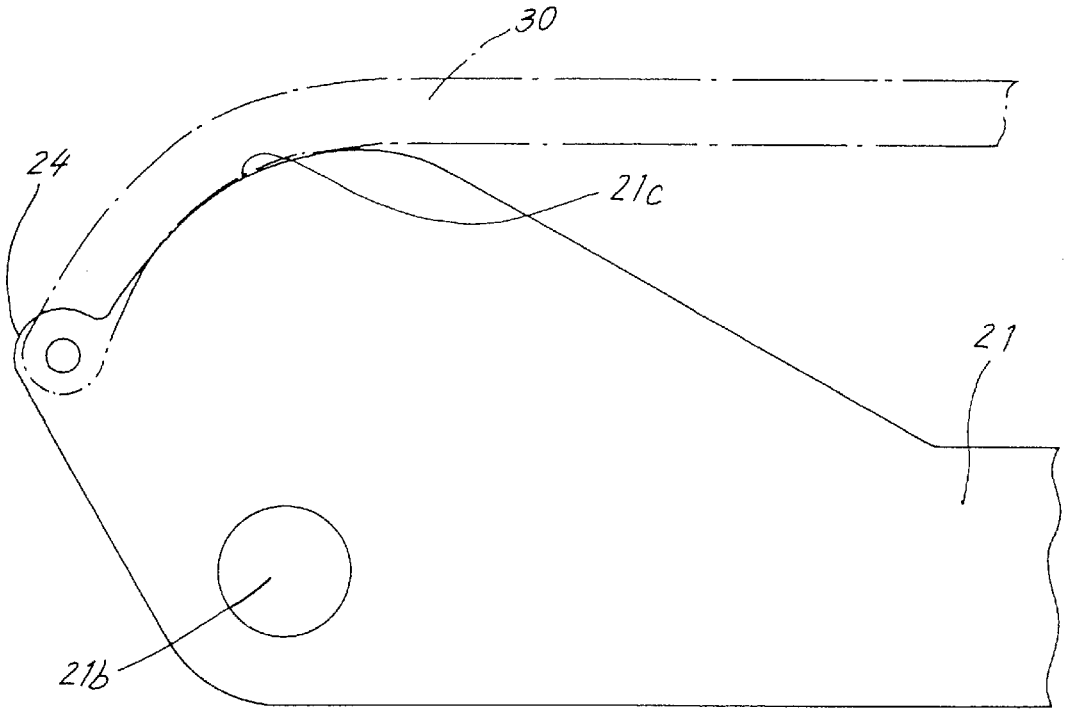
FIG. 4 is a side elevation showing a free end of a drive arm.

FIG. 4 shows the cam face 21*c* formed on the free end of the lower drive arm 21 in greater detail. A mount portion 24 for the traction member 30, such as a chain, is formed in a projecting manner at the extremity of the free end of the arm 21. The cam face 21*c* for permitting the chain 30 to bear on extends from the mount portion 24 in the direction of rise of the lower drive arm 21. The cam face 21*c* is generally in the form of a circular arc and so bulges as to be a greater distance away from a second pivot second 21*b* for supporting the arm 21 on an intermediate bracket 32 as the cam face extends from the mount portion 24, the circular-arc face being so shaped that the chain 30 will be parallel to the base 14 when the drive arm 21 is parallel to the base 14.

The upper drive arm 23 is similarly formed with a cam face 23*c* and a mount portion 25 for attaching a traction member 30 to the arm 23.

The lower support arm 20 and the lower drive arm 21 are arranged in parallel and have their free ends pivoted to a lower portion of the intermediate bracket 32 in common. The distance between the first pivots 20*a*, 21*a* provided on the lower bracket 18 for the respective arms 20, 21 is equal to the distance between the second pivots 20*b*, 21*b* on the intermediate bracket 32.

The intermediate bracket 32 comprises generally hexagonal right and left two opposite plates each pivotally supporting the free ends of the lower drive arm 21 and support arm 20 from outside. The two plates are interconnected by a connecting plate 36. The intermediate bracket 32 is so shaped that the upper and lower portions thereof are symmetric with respect to a phantom center line B parallel to the base 14. The lower support arm 20 and drive arm 21 are pivoted to the lower portion of the bracket 32 below the center line B.

The upper support arm 22 and the upper drive arm 23 are pivoted at their base ends to the intermediate bracket 32 above the center line B. The first pivot 22*b* of the upper support arm 22 and the first pivot 23*b* of the upper drive arm 23 are positioned symmetrically with the second pivot 20*b* of the lower support arm 20 and the second pivot 21*b* of the lower drive arm 21 with respect to the center line B of the bracket 32. The upper support arm 22 has the same shape as the lower support arm 20. The upper drive arm 23 is identical with the lower drive arm 21 in shape. The cam face 23*c* of the upper drive arm 23 is opposed to the cam face 21*c* of the lower drive arm 21.

The upper support arm 22 and upper drive arm 23 have free ends pivoted to an upper bracket 40 by respective second pivots 22*a*, 23*a* to position the arms 22, 23 in parallel. The table 10 is mounted on the top of the upper bracket 40 so as to be parallel to the base 14.

The intermediate bracket 32 is provided with a hydraulic cylinder unit 42 serving as lift control means. The cylinder unit 42 is mounted as directed rearward on the connecting plate 36 at the front side of the bracket 32 in alignment with the center line B (see FIG. 1) of the bracket 32. The cylinder unit has a piston rod 43 with a lateral mount plate 44 provided at the outer end of the rod. The chains 30, 30 serving as traction members each have one end attached to the mount plate 44.

The other ends of the chains 30, 30 are attached respectively to the mount portions 24, 25 of the drive arms 21, 23.

Hydraulic oil is supplied to the cylinder unit 42 by a pump mechanism 50 communicating with the unit by an oil channel 46. The pump mechanism 50 is disposed at the rear of the pushcart 5. The hydraulic oil, which is accommodated in a pump 53, is supplied to a cylinder 45 of the unit 42 via the oil channel 46 by a plunger 52 which applies pressure to the pump 53. The plunger 52 is operated by the pedal mechanism 60 to be described later. The plunger 52 is biased rearward by a spring 54 and has a rear end always bearing on a pusher 62 of the pedal mechanism 60.

The oil channel 46 is provided with a check valve (not shown) permitting passage of the oil only from the pump 53 to the cylinder unit 42.

The oil is discharged from the cylinder unit 42 via a drain passageway (not shown) holding the unit 42 in communication with the pump 53. The passageway is provided with an unillustrated valve, which can be opened or closed by turning a valve lever (not shown) connected to the valve.

The preferred embodiment of pedal mechanism 60 will be described below.

Figure 5:
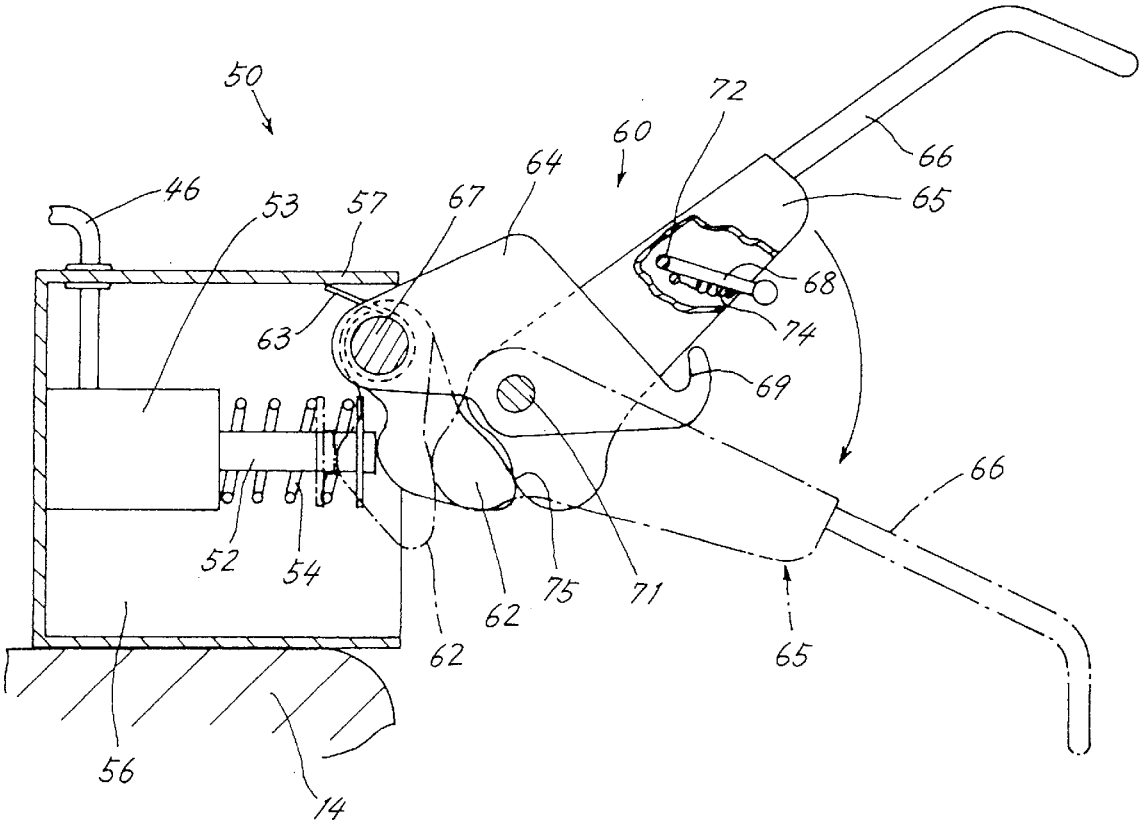
FIG. 5 is a sectional view of a pump mechanism with a pedal mechanism set in a usual mode.
Figure 6:
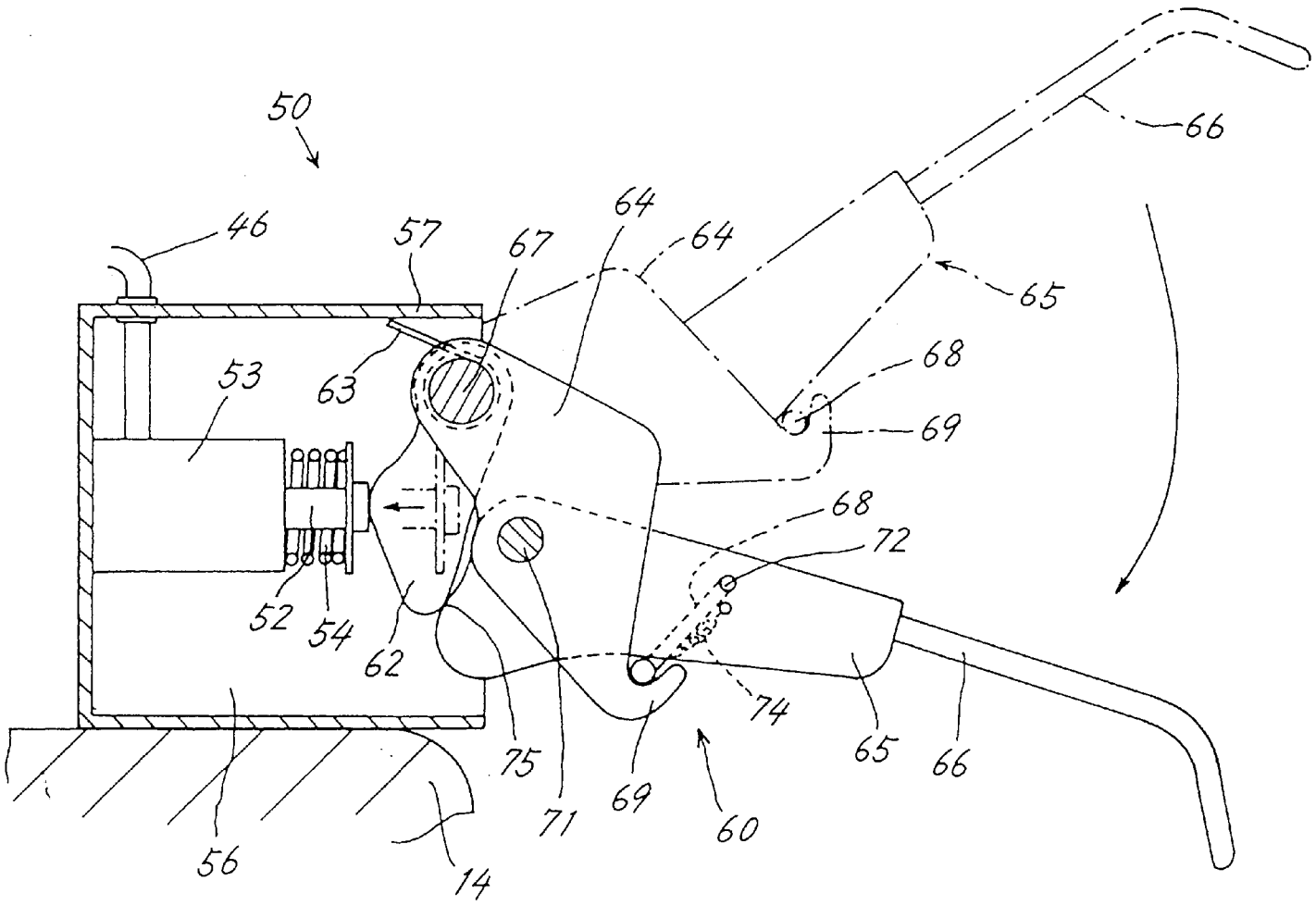
FIG. 6 is a sectional view of the pump mechanism with the pedal mechanism set in a high speed mode.

As shown in FIG. 1, the pedal mechanism 60 is disposed at the rear of the pushcart 5 and adjacent the pump mechanism 50. FIGS. 5 and 6 are sectional views of the pedal mechanism 60.

The pedal mechanism 60 comprises a pair of right and left plates 64, 64 arranged between and pivotally supported by brackets 56, 56 on the base 14 of the pushcart 5 and biased rearwardly upward by torsion springs 63, 63, a pedal 66 having a base member 65 disposed between and pivotably supported by the plates 64, 64, and the above-mentioned pusher 62 pivoted to the brackets 56.

The brackets 56, 56 are arranged on the upper side of the base 14 of the pushcart 5 at the widthwise midportion thereof. The upper ends of the brackets 56, 56 are interconnected by a stopper 57 for limiting the upward pivotal movement of the plates 64.

The plates 64 are supported by a pivot 67 between the brackets 56, 56 and biased into bearing contact with the stopper 57 of the brackets 56 by the torsion springs 63 which are provided around the pivot. Each plate 64 has a free end formed with a hook 69 which is engageable with a T-shaped pin 68 on the pedal base member 65.

The torsion springs 63 biasing the plates 64 permit pivotal movement of the plates 64 when the pedal 66 is stepped on, with the plates 64 in engagement with the pedal base member 65 as will be described below. However, the springs have such a spring constant that the plates 64 remain almost unmoved even if the pedal 66 is stepped on when the base member 65, as disengaged from the plates 64, moves about its pivoted position.

The pedal base member 65 is in the form of a channel with its opening facing down, has a base end pivoted to the plates 64 as indicated at 71 and is provided with the pedal 66 at its rear end. The T-shaped pin 68 has a base end pivoted to the approximate midportion of the base member 65 as indicated at 72, and a free end opposite side portions of which are adapted to bear on the downward open edges of the base member 65. A snap action spring 74 attached to the pin 68 biases the pin 68 so that the pin 68 pivotally moves upward or downward and is positioned in place by contact with the open edges of the base member 65. The side portions of the free end of the pin 68 are engageable with or disengageable from the hooks 69 at the free ends of the plates 64. The pedal base member 65 is formed at its base end with a contact portion 75 bearing on the pusher 62.

The pusher 62 is rotatably mounted on the same pivot 67 as the plates 64 and is disposed between the pedal base member 65 and the plunger 52. The base member 65 is pivoted at its base end to the plates 54 as at 71 and therefore so urged to rotate about the pivot 71 by the gravity acting on the pedal 66, bringing the contact portion 75 into bearing contact with the pusher 62. The pusher 62, which is pivotally movably mounted, is pushed by the contact portion 75 into contact with the outer end of the plunger 52 at all times. Incidentally, the spring 54 biasing the plunger 52 has such a spring constant that the plunger 52 remains almost immovable when subjected only to the pushing-in force afforded by the gravity on the pedal 66.

When the pedal 66 is stepped on in the state (usual mode) wherein the plates 64 are out of engagement with the base member 65 as seen in FIG. 5, the pedal 66 moves about the pivot 71 supporting the base member 65 on the plates 64, pushing the pusher 62 by the contact portion 75 (as indicated in dot-and-dash lines in FIG. 5). The pusher 62 in turn pushes the plunger 52 forward, causing the pump 53 to supply the hydraulic oil to the cylinder unit 42 to move the piston rod 43 rearward.

When the pedal 66 is released from the stepping force, the plunger 52 is moved rearward by the force of the spring 54 provided around the plunger 52, causing the pusher 62 and the base member 65 to restore the original state by pushing.

The T-shaped pin 68 is engaged by the hooks 69 of the plates 64 (high speed mode, indicated in dot-and- dash lines in FIG. 6) by pushing down the plates 64 only from the state of FIG. 5, turning the pin 68 downward into contact with the open edges of the channel-shaped base member 65 and returning the plates 64, whereby the pedal base member 65 is locked to the plates 64. When depressed in this state, the pedal 66 moves about the pivot 67 supporting the plates 64 on the brackets 56. The distance from the contact portion 75 of the base member 65 to the center of movement of the pedal in this case is greater than when the plates 64 are out of engagement with the base member 65. Consequently, a single stepping action on the pedal 66 moves the contact portion 75 by a greater amount, increasing the amount of movement of the pusher 62 and the plunger 52. This increases the quantity of oil to be supplied from the pump to the cylinder unit 42, lifting the table 10 by a greater amount.

When the pedal 66 is released from the stepping force, the force of the spring 54 provided on the plunger 52 moves the plunger 52 rearward, returning the pusher 62 to the original state. The plates 64 in engagement with the base member 65 are returned to the original state by the torsion springs 63 biasing the plates 64 upward.

When the plates 64 only are depressed against the springs 63 while in engagement with the base member 65, the pin 68 can be disengaged from the hooks 69 if pulled rearward.

[Ascent of the Table]

When the pedal 66 of the pedal mechanism 60 is stepped on, the pedal base member 65 moves about the pivot 71, causing the contact portion 75 to push the pusher 62 and the plunger 52, with the result that the plunger 52 moves forward to supply the hydraulic oil from the pump 53 to the cylinder unit 42 via the check valve.

The oil supplied to the cylinder unit 42 pushes out the piston rod 43 rearward. With the rearward movement, the chains 30, 30 provided between the outer end of the piston rod 43 and the upper and lower drive arms 21, 23 pull these arms 21, 23 in a direction to raise the arms. Since the support arms 20, 22 pivotally move always in parallel to the respective corresponding drive arms 21, 23, the rise of the drive arms 21, 23 also raises the support arms 20, 22. The lower drive arm 21 and support arm 20, when raised, move the intermediate bracket 32 obliquely rearward in parallel to the lower brackets 18. Further the rise of the arms 20 to 23 translates the upper brackets 40 vertically upward, lifting the table 10.

The portions of the drive arms 21, 23 in contact with the respective chains 30, 30 are formed with the cam faces 21*c*, 23*c* which are generally circular-arc in contour, so that during the ascent of the table 10 from its lowest position to the highest lifted position, the amount of pull of the chains 30 by the piston rod 43 is in proportion to the amount of ascent of the table 10. Accordingly, if the rate of supply of hydraulic oil to the cylinder unit 42 by a single stepping action on the pedal is constant, the rate of ascent of the table 10 is also constant.

[Decent of the Table]

The table 10 is lowered by turning the valve lever to open the valve and discharging the hydraulic oil from the cylinder unit 42 to the pump 53. When the oil is discharged, the piston rod 43 moves forward to slacken the chains 30, permitting the arms to move in a falling direction reverse to the raising direction under the gravity acting on the table 10, etc. At this time, the cam faces 21*c*, 23*c* progressively come into contact with the respective chains 30, 30. The arms 20 to 23 falling down lower the intermediate bracket 32, the upper bracket 40 and the table 10.

When the rate of supply of the hydraulic oil from the pump 53 by stepping on the pedal 66 is constant, the table 10 moves upward at a constant rate because the cam faces 21*c*, 23*c* of the drive arms 21, 23 are so contoured as described above. The cam faces 21*c*, 23*c* can be shaped otherwise, for example, in an elliptical form or in the form of combination of a circular-arc form and an elliptical form. In the case where the table 10 can be made movable at varying rates by a single stepping action on the pedal 66, the cam faces 21*c*, 23*c* can be, for example, straight faces or circular-arc faces centered about the respective pivots 21*b*, 23*b*.

In the case where the phantom line A through the first pivots 20*a*, 21*a* on the lower bracket 18 makes an angle of 45 degree with the base 14, the arms 20, 21, 22, 23 become parallel to the base 14 when the table 10 is lowered, so that the table 10 can be brought down to a lower level. This also decreases the height of the device for storage. However, the angle is not limited to 45 degree according to the invention.

Figure 7:
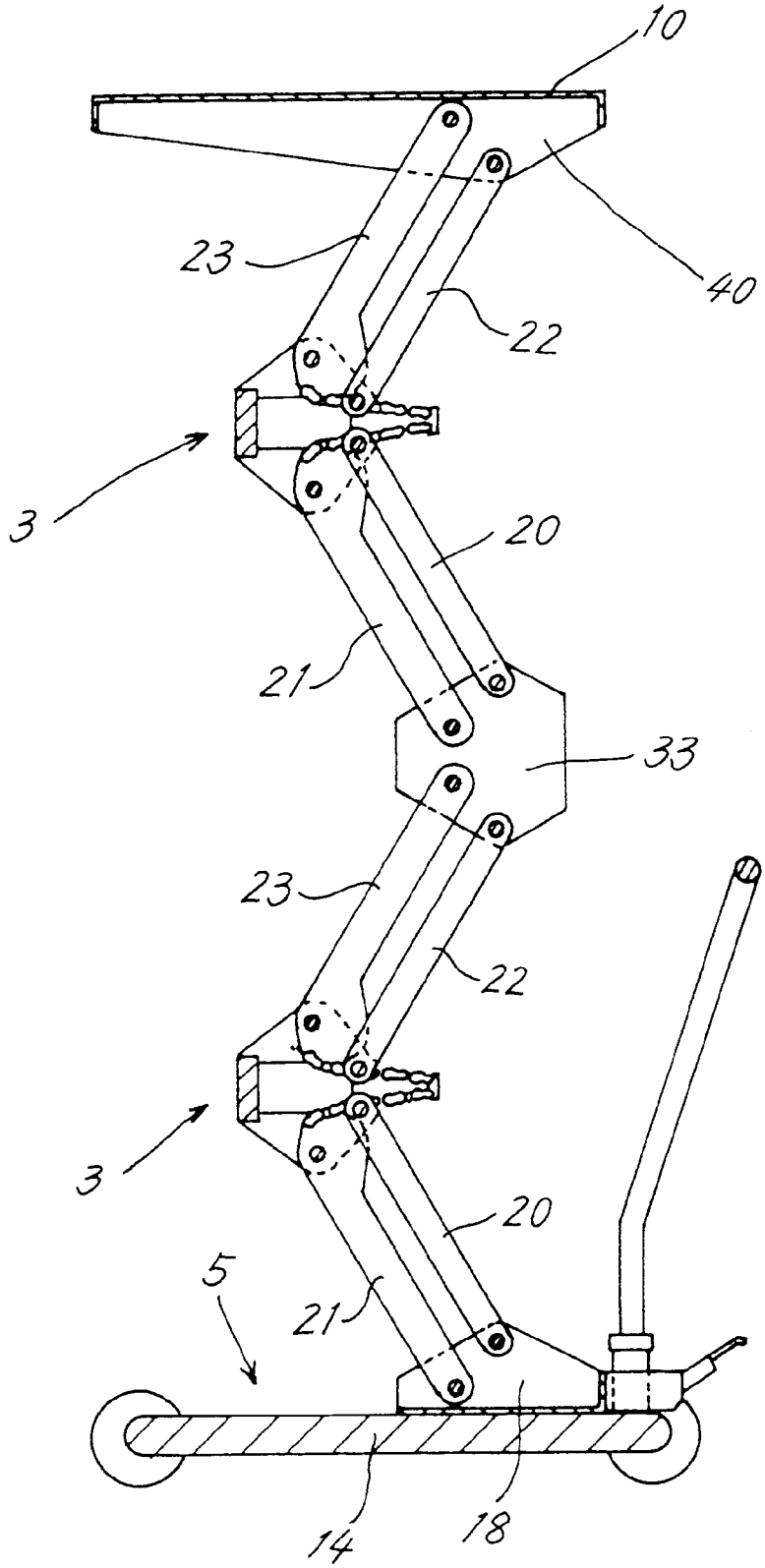
FIG. 7 is a sectional view of an embodiment comprising a plurality of lift mechanisms in combination.
Figure 8:
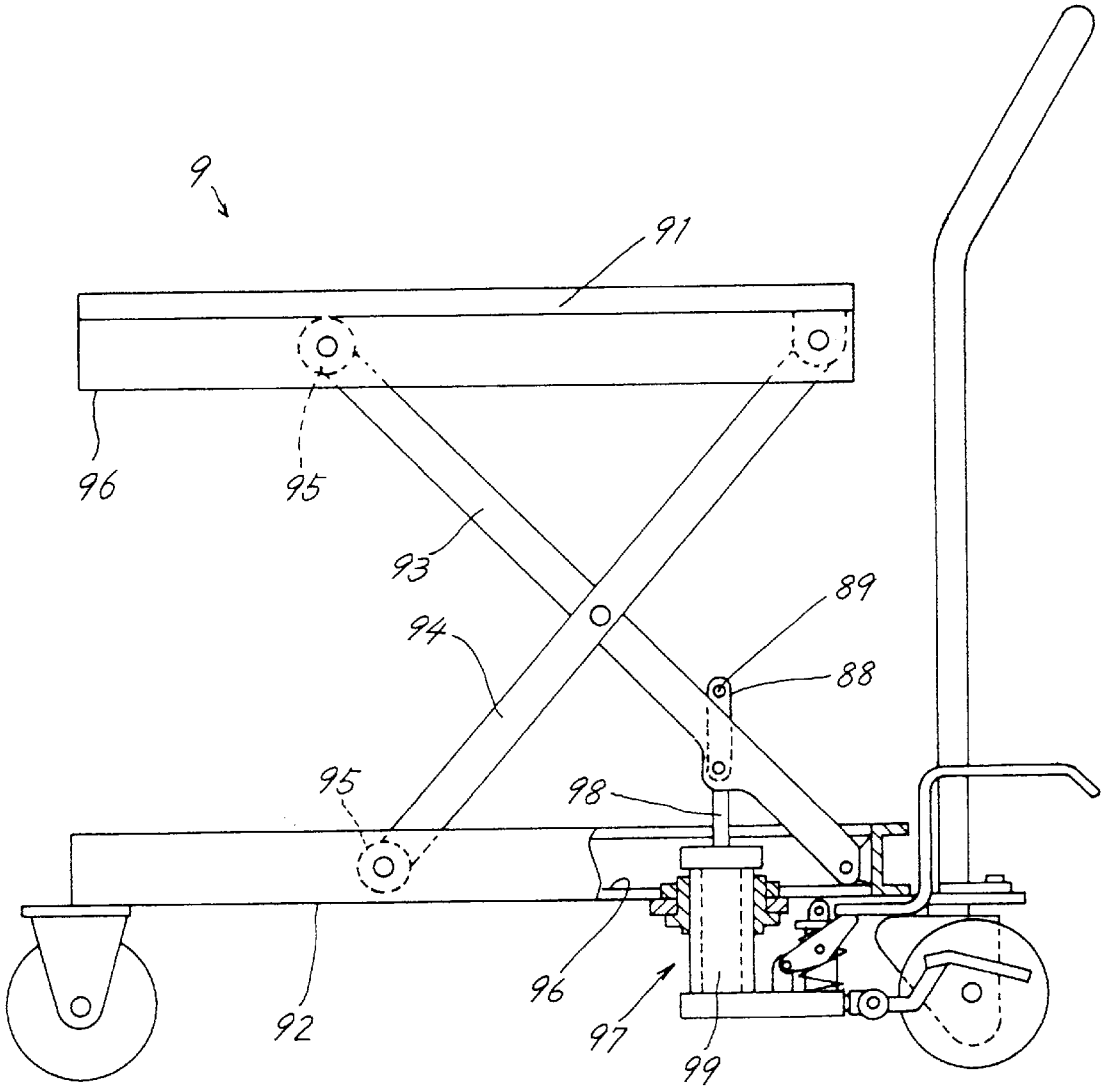
FIG. 8 PRIOR ART
FIG. 8 is a view showing conventional table lift device.

A plurality of lift mechanisms 3 can be used as connected together as seen in FIG. 7. In this case, the upper bracket 40 of the lower lift mechanism 3 and the lower bracket 18 of the upper lift mechanism 3 are made into an auxiliary bracket 33, such that the upper arms 22, 23 of the lower lift mechanism and the lower arms 20, 21 of the upper lift mechanism are pivoted to the auxiliary bracket 33. The table 10 is attached to the top of the upper bracket 40 of the upper lift mechanism.

The means for supplying and discharging the oil from the hydraulic cylinder unit 42 is not limited to the pedal mechanism 60 of the foregoing construction but can be other mechanism.

The traction member 30 is not limited to a chain but can be a wire rope, cable or the like.

When the arms of the table lift device 1 are given such a length as to be stowed under the table 10, the table 10 can be made liftable by an amount corresponding to about twice the length of the table 10.

With the cam faces 21*c*, 23*c* of the drive arms 21, 23 so shaped as described above, the table 10 can be lifted at an approximately constant rate from the vicinity of the lowest position of the table to the vicinity of the highest raised position by a single oil supply action for the hydraulic cylinder unit 42.

Further when the pedal mechanism 60 described is used for the pump mechanism 50 for supplying the hydraulic oil to the cylinder unit 42, the amount of lift of the table 10 by a single stepping action on the pedal can be altered as desired.

Second Embodiment

With reference to FIGS. 9 to 14, an embodiment will be described below in which a pair of lift mechanisms of the invention are mounted on a base to provide a table tilt-lift device 101.

Figure 9:
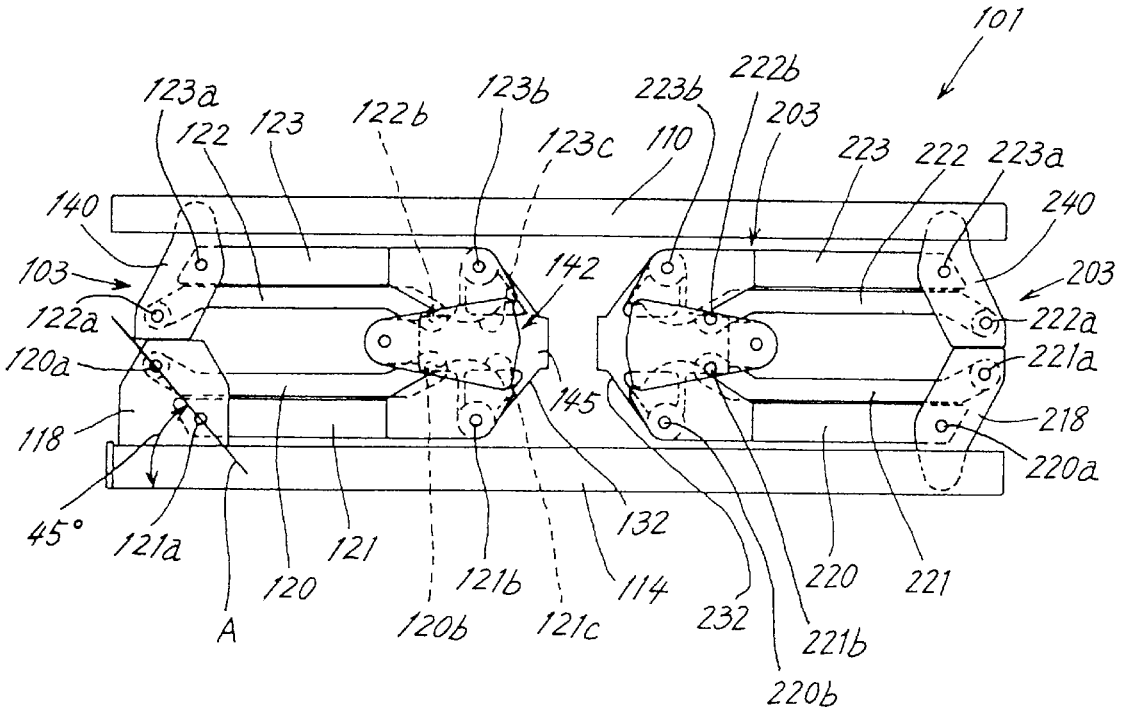
FIG. 9 is a front view of a table tilt-lift device with a table in a lowered position.
Figure 10:
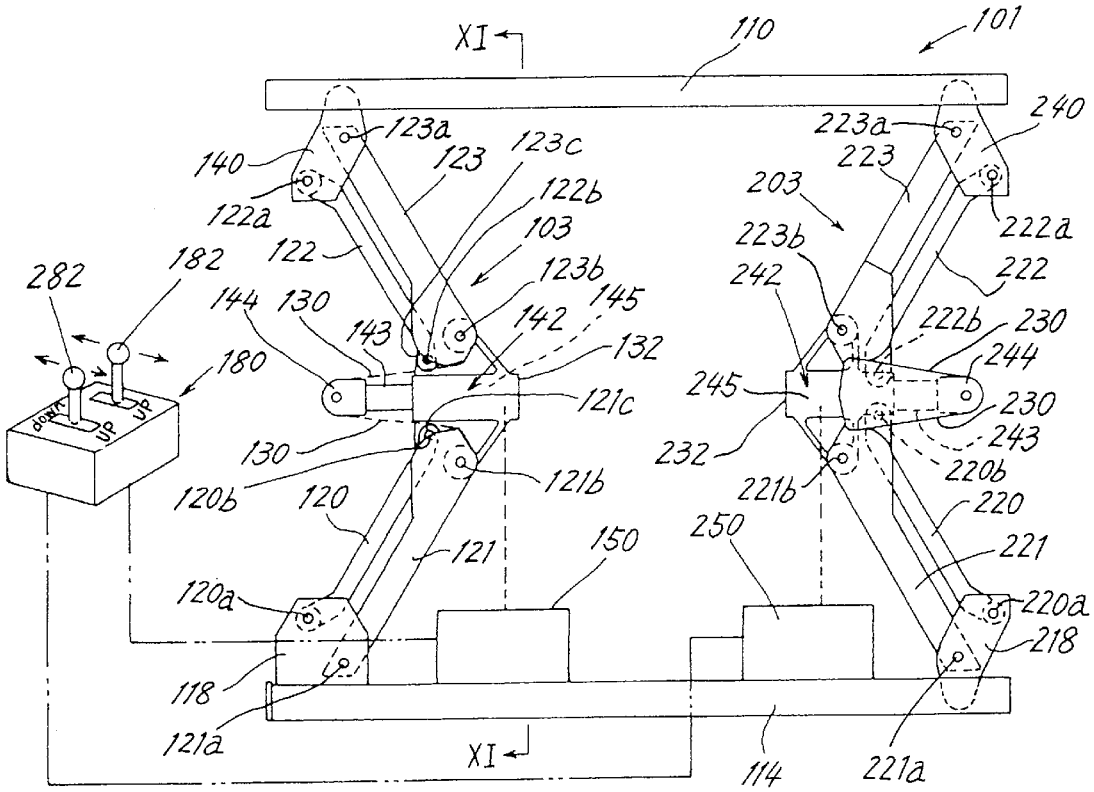
FIG. 10 is a sectional view of the table tilt-lift device with the table in a lifted position.
Figure 11:
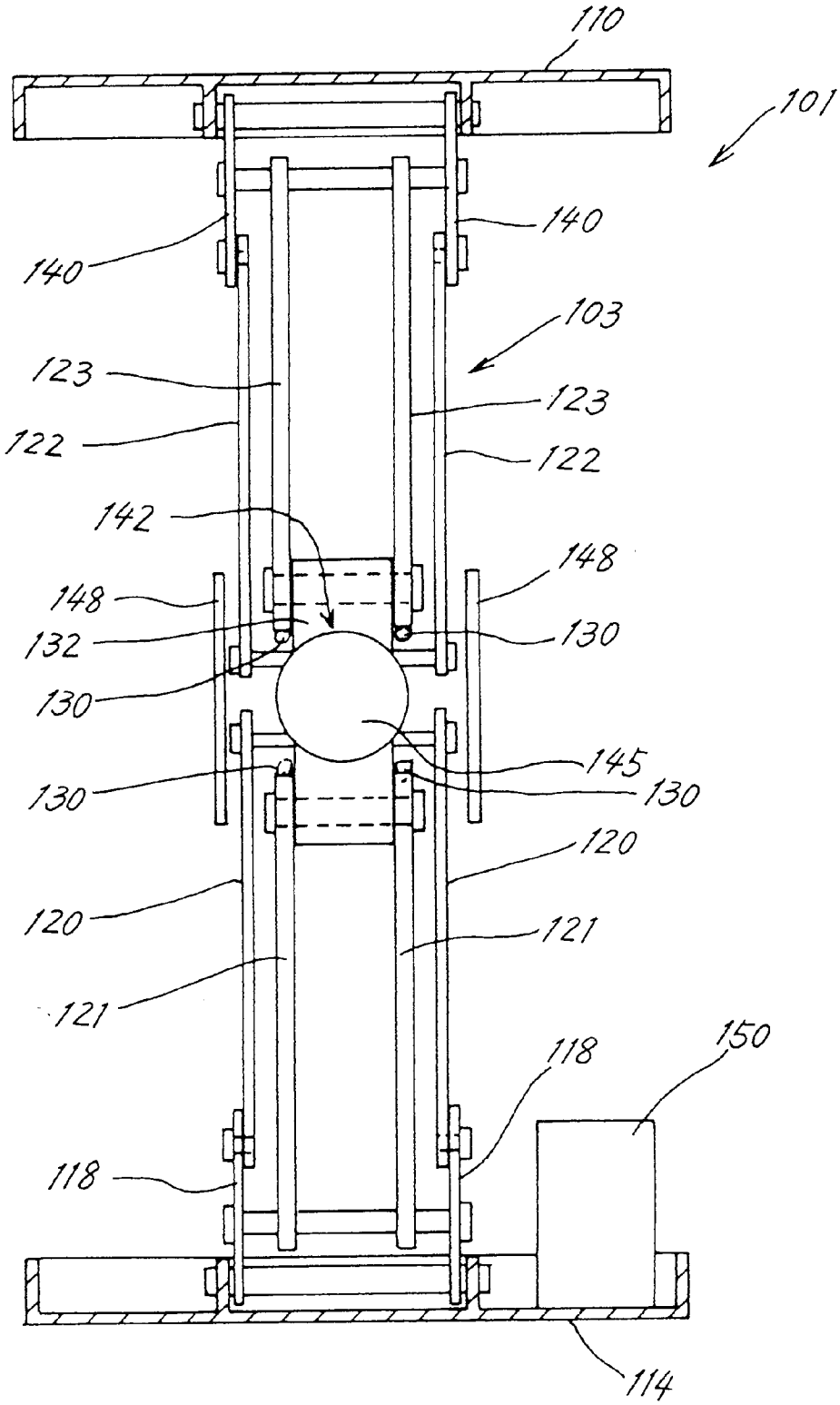
FIG. 11 is a view in section taken along the line XI—XI in FIG. 10.
Figure 12:
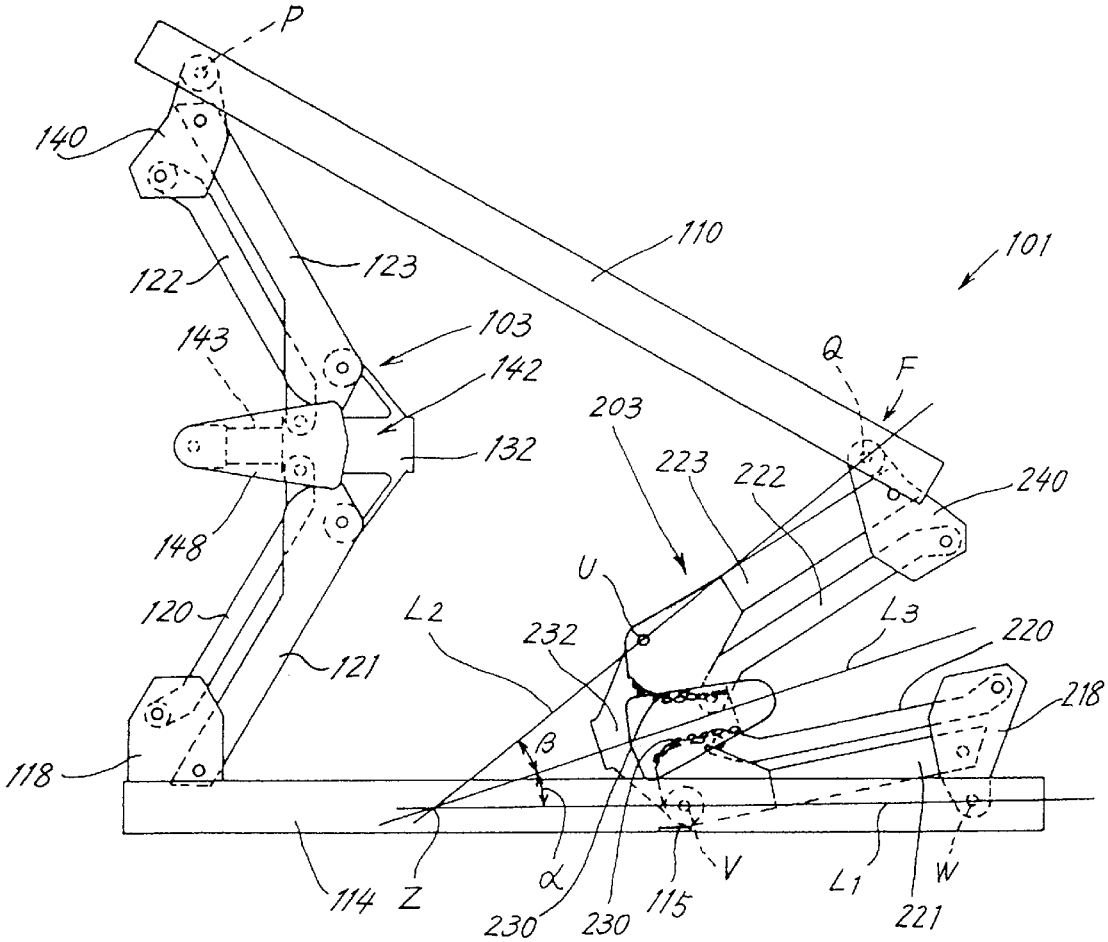
FIG. 12 is a front view of the table tilt-lift device with the table tilted to the greatest extent.
Figure 13:
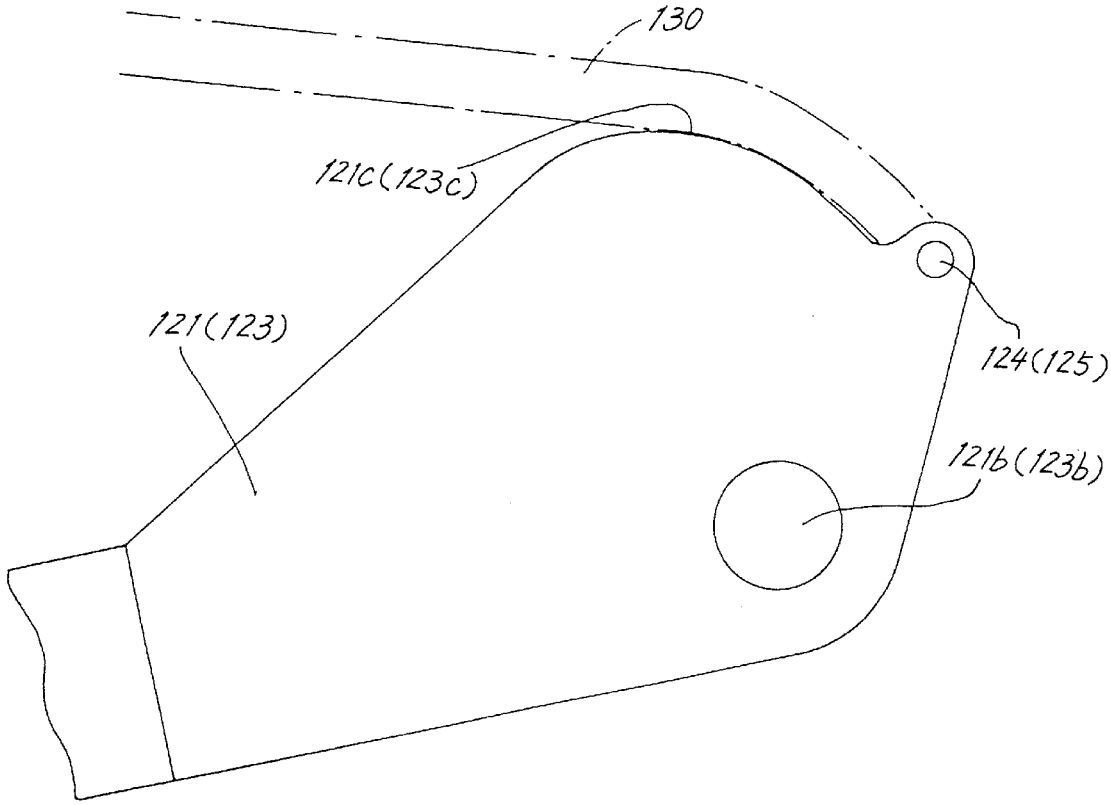
FIG. 13 is a diagram for illustrating a chain as connected to a lover drive arm.

FIG. 9 shows a table 110 as lowered to the lowest level, FIG. 10 shows the same as lifted to the highest level, and FIG. 12 shows the table 110 as tilted to the greatest extent.

For the sake of convenience of description, the term "front" as used in the following description of the embodiment refers to the left-hand side of FIGS. 9, 10 and 12, and the term "rear" to the right-hand side thereof.

The tilt-lift device 101 comprises a pair of lift mechanisms 103, 203 arranged as opposed to each other on a base 114 at the front and rear thereof. The table 110 is mounted on the upper ends of the two lift mechanisms 103, 203. Lower brackets 118, 118 positioned along the front-rear direction are fixed to the front end of the base 114. Lower brackets 218, 218 are attached to the rear end of the base 114 and pivotally movable each in a vertical plane in the front-rear direction. The lift mechanisms 103, 203 are supported by the respective pairs of the lower brackets 118, 118 and 218, 218.

Each of the lift mechanisms 103, 203 comprises lower support and drive arms 120, 121 (220, 221) and upper support and drive arms 122, 123 (222, 223), which are pivoted to and interconnected by an intermediate bracket 132 (232). The arms are raised or caused to fall down by a hydraulic cylinder unit 142 (242) on the intermediate bracket 132 (232). The lift mechanisms are substantially the same as that of the first embodiment in construction and therefore will not be described in detail.

The drawings show pivots 120*a*, 120*b*, 121*a*, 121*b*, 122*a*, 122*b*, 123*a*, 123*b*, 220*a*, 220*b*, 221*a*, 221*b*, 222*a*, 222*b*, 223*a*, 223*b*.

The cylinder unit 142 of the front lift mechanism 103 has a forwardly directed piston rod 143, and the cylinder unit 242 of the rear lift mechanism 203 has a rearwardly directed piston rod 243, the piston rods thus being arranged symmetrically on the base 114.

The upper support arm 122 (222) and the upper drive arm 123 (223) have free ends pivoted to an upper bracket 140 (240). The upper ends of the upper brackets 140, 240 are pivoted to the table 110.

The cylinder unit 142 is mounted on the front intermediate bracket 132 and has a cylinder 145 formed at the center of the bracket 132, with the piston rod 143 projecting forward from the cylinder. Similarly, the cylinder unit 242 is mounted on the rear intermediate bracket 232, with the piston rod 243 projecting rearward from a cylinder 245.

The piston rods 143, 243 have forward and rearward heads 144, 244 at their outer ends, respectively. Two chains 130 or 230 serving as traction members are attached each at its one end to each head. The other ends of the chains 130, 130 are attached to mount portions 124, 125 of the drive arms 121, 123 (see FIG. 13). Similarly, the other ends of the chains 230, 230 are attached to like mount portions.

Safety covers 148 extending rearward are attached to the right and left sides of the head 144, and are movable forward and rearward with the piston rod 143.

Hydraulic oil is supplied to the cylinder units 142, 242 of the lift mechanisms 103, 203 by respective automatic pump mechanisms 150, 250 which are independent of each other. The pump mechanisms 150, 250 are so positioned on the base 114 as not to interfere with the ascent and descent of the table 110, and are coupled to a common remote controller 180.

The remote controller 180 has two manual levers 182, 282 respectively for driving the front lift mechanism 103 and the rear lift mechanism 203. When each lever is moved in "UP" or "DOWN" direction indicated, hydraulic oil is supplied to or discharged from the corresponding cylinder unit. The two manual levers 182, 282 can be manipulated also at the same time.

Next, the operation of the table tilt-lift device will be described.

[Table Tilting Operation]

A case will be described wherein the table 110 at the lowest level as shown in FIG. 9 is tilted with the front side raised as seen in FIG. 12.

The lever 182 on the remote controller 180 for the front pump mechanism 150 is moved in the "UP" direction. The pump mechanism 150 supplies the oil to the cylinder unit 142 of the lift mechanism 103, projecting the piston rod 143 forward. When the piston rod 143 is projected, the chains 130, 130 connecting the front end of the piston rod 143 to the respective lower and upper drive arms 121, 123 pull the arms 121, 123 in a direction to raise these arms.

Since the lower and upper support arms 120, 122 pivotally move always in parallel to the respective drive arms 121, 123 in corresponding relation, the rise of the drive arms 121, 123 also raises the support arms 120, 122. The rise of the lower drive arm 121 and the lower support arm 132 moves up the intermediate bracket 132 along a circular-arc path while permitting the bracket to remain in the same posture. The rise of the arms 120 to 123 also moves up the upper bracket 140 vertically to lift the front side of the table 110.

The portions of the drive arms 121, 123 on which the respective chains 130, 130 bear are formed with cam faces 121*c*, 123*c* having an approximately circular-arc contour, the cam faces 121*c*, 123*c* extending in the approximate circular-arc form so as to be gradually a greater distance away from the respective pivots 121*b*, 123*b* of the drive arms on the intermediate bracket 132. Accordingly, the amount of pull on the chains 130 by the piston rod 143 is in proportion to the amount of rise of the table 110 over the entire range of from the lowest position of the table to the highest raised position. If the rate of supply of the hydraulic oil to the cylinder unit 142 per unit time is constant, the table 110 is therefore lifted also at a constant rate.

With reference to FIG. 12, a description will be given of the load acting on the rear lift mechanism 202 when the front lift mechanism 103 is operated in the rising direction.

When the front lift mechanism 103 starts to move in the rising direction, the rear lift mechanism 203 tilts in its entirety with the cylinder unit side thereof lowered so as to permit variations in the distance between the upper ends of the front and rear lift mechanisms 103, 203, and the rear mechanism comes into contact with a stopper plate 115 on the base 114.

When the front lift mechanism 103 further moves in the rising direction as seen in FIG. 12, the upper bracket 240 on the upper support arm 222 and the upper drive arm 223 of the rear lift mechanism 203 is slightly pulled up. Now suppose the front upper bracket 140 is pivoted to the table 110 at P, the rear upper bracket 240 is pivoted to the table 110 at Q, the rear upper drive arm 223 is pivoted to the intermediate bracket 232 at U (223*b*), the rear lower drive arm 221 is pivoted to the intermediate bracket 232 at V (221*b*), the rear lower support arm 220 is pivoted to the lower bracket 218 at W, and a line L1 through the pivots U and W intersects a line L2 through the pivots Q and U at a point Z. At this time, a tangential force F acts about the pivot P of the front upper bracket 140 on the table 110, so that the angle QZW tends to become minimum to attain a balance.

The center line L3 of the hydraulic cylinder unit 242 extends through the point of intersection Z at all times, dividing the angle QZW into two equal angles, i.e., $\alpha=\beta$.

Accordingly, the upper and lower chains 230, 230 on the piston rod 243 are tensioned similarly. When the rear lift mechanism 203 subsequently moves for rising, the lower arms 220, 221 and the upper arms 222, 223 of the rear lift mechanism 203 therefore start to rise at the same time. This renders the piston rod 243 free of eccentric load, preventing the piston rod 243 from bending and permitting the rod 243 to project smoothly.

[Adjustment of Tilt of the Table]

When the rear lift mechanism 203 is operated with the front lift mechanism 103 brought to the raised state, the rear side of the table 110 is raised in the same manner as above.

The tilt of the table 110 can be adjusted as desired by varying the difference in level between the upper brackets 140, 240 of the two lift mechanisms 103, 203.

The table 110 can be lifted in a horizontal state by operating the two lift mechanisms 103, 203 at the same time from the start.

The lift mechanisms 103, 203 can be operated at the same time with the table 110 tilted, whereby the table can be lifted as tilted. Thus the table 110 can be held at a desired level at a desired angle.

[Descent of the Table]

The table 110 can be lowered by moving the levers 182, 282 on the remote controller 180 in "DOWN" direction and thereby discharging the oil from the cylinder units 142, 242. The discharge of the oil retracts the piston rods 143, 243 to slacken the chains 130, 230, permitting the arms to pivotally move in the falling direction reverse to the rising direction under the gravity acting on the table 110, etc. At this time, the chains 130 progressively come into contact with the respective cam faces 121*c*, 123*c*, and the chains 230 into contact with the respective cam faces 221*c*, 223*c*. The pivotal movement of the arms 120 to 123 and 220 to 223 lowers the intermediate brackets 132, 232 and the upper brackets 140, 240 to move the table 110 down.

When the cam faces of the drive arms are so contoured as described above and if the rate of supply of the hydraulic oil from the pumps 150, 250 is constant, the table 110 can be lifted at a constant rate. The cam faces 121*c*, 123*c*, 221*c*, 223*c* can be shaped otherwise, for example, in an elliptical form or in the form of combination of a circular-arc form and an elliptical form.

When an angle of 45 degree is formed between the base 114 and a phantom line A through the centers of the pivots 120*a*, 121*a* of the lower support arm 120 and drive arm 121 on the lower bracket 118 as shown in FIG. 9, the arms 120, 121, 122, 123 become parallel to the base 114 when the table 110 is lowered. The table 110 can then be brought to a lower level to reduce the height of the device when it is in a standby state.

Pumps equipped with a pedal mechanism are usable for supplying and discharging the oil to and from the cylinder units 142, 242.

Figure 14:
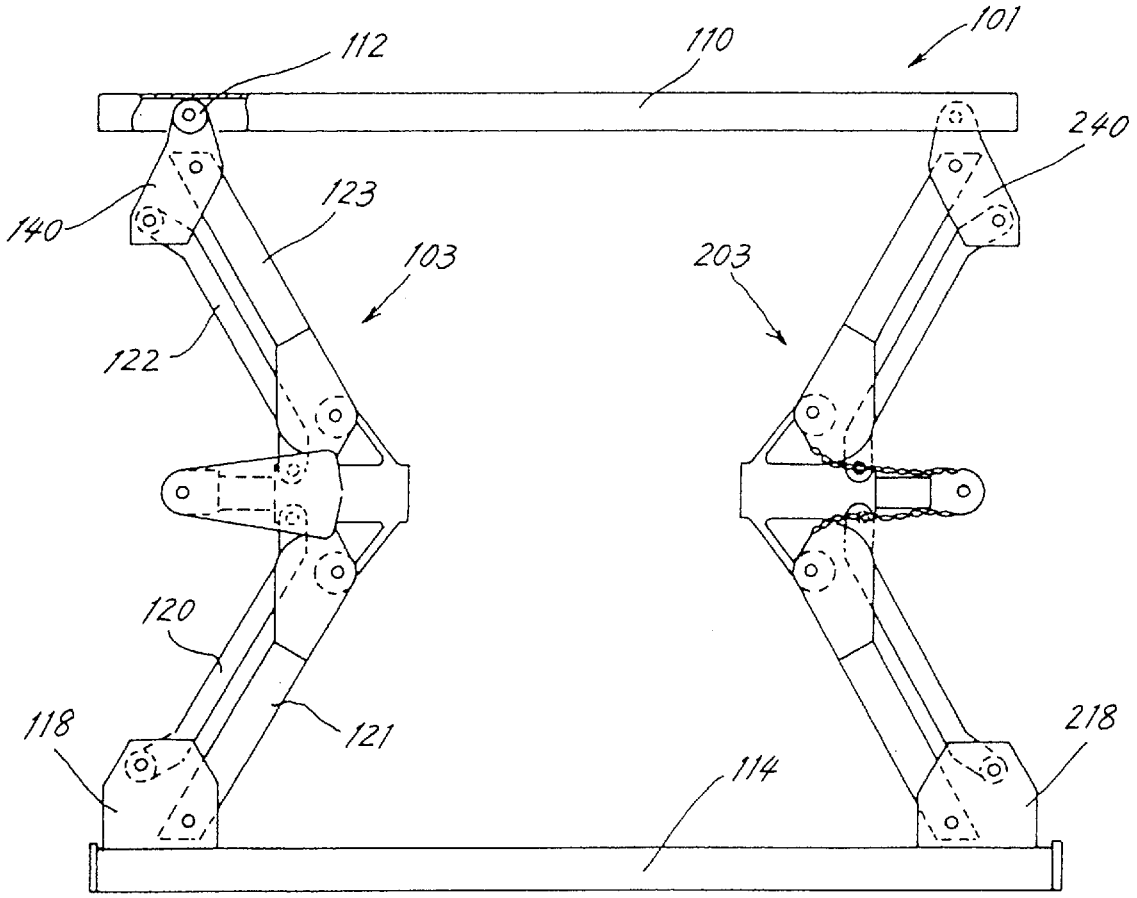
FIG. 14 is a front view of another embodiment of table tilt-lift device.

According to the embodiment described, the lower brackets 118, 118 of the front lift mechanism 103 are fixed to the base 114, and the lower brackets 218, 218 of the rear lift mechanism 203 are pivoted to the base 114, whereas the lower brackets 118, 118 of the front lift mechanism 103 and the lower brackets 218, 218 of the rear lift mechanism 203 are both fixed to the base 114 in the tilt-lift device of FIG. 14.

To permit variations in the distance between the upper ends of the front and rear lift mechanisms 103, 203 when the table 110 is tilted by operating only one of the mechanisms in this case, the upper end of one of the lift mechanisms is provided with rollers 112 rollable on the lower surface of the table or made slidable in a slot (not shown) of the table 110 with use of a pin joint.

In the case of FIG. 14, the upper brackets 140, 240 of the front and rear lift mechanisms 103, 203 vertically move upward and downward.

The mechanisms for tilting and lifting the table can be arranged under the table. This diminishes the space needed for the installation of the tilt-lift device 101.

Regardless of the level or tilt of the table, there is nothing positioned higher than the table, so that the work to be placed on the table can be worked on or processed without any interference.

The arrangement wherein the hydraulic cylinder unit provided on the intermediate bracket raises the arms or causes the arms to fall down for the operation of the tilt-lift device makes it possible to increase the difference between the highest level and lowest level of the table, thus rendering the table usable over an increased range of levels.

When a vertical cylinder unit is used for lifting and lowering the table, the length of the cylinder of the unit impose a limitation on the level to which the table can be lowered, whereas the present device is free of such limitation. Consequently the lowest level of the table can be lowered to render the device less bulky while it is not in use.

Third Embodiment

Figure 15:
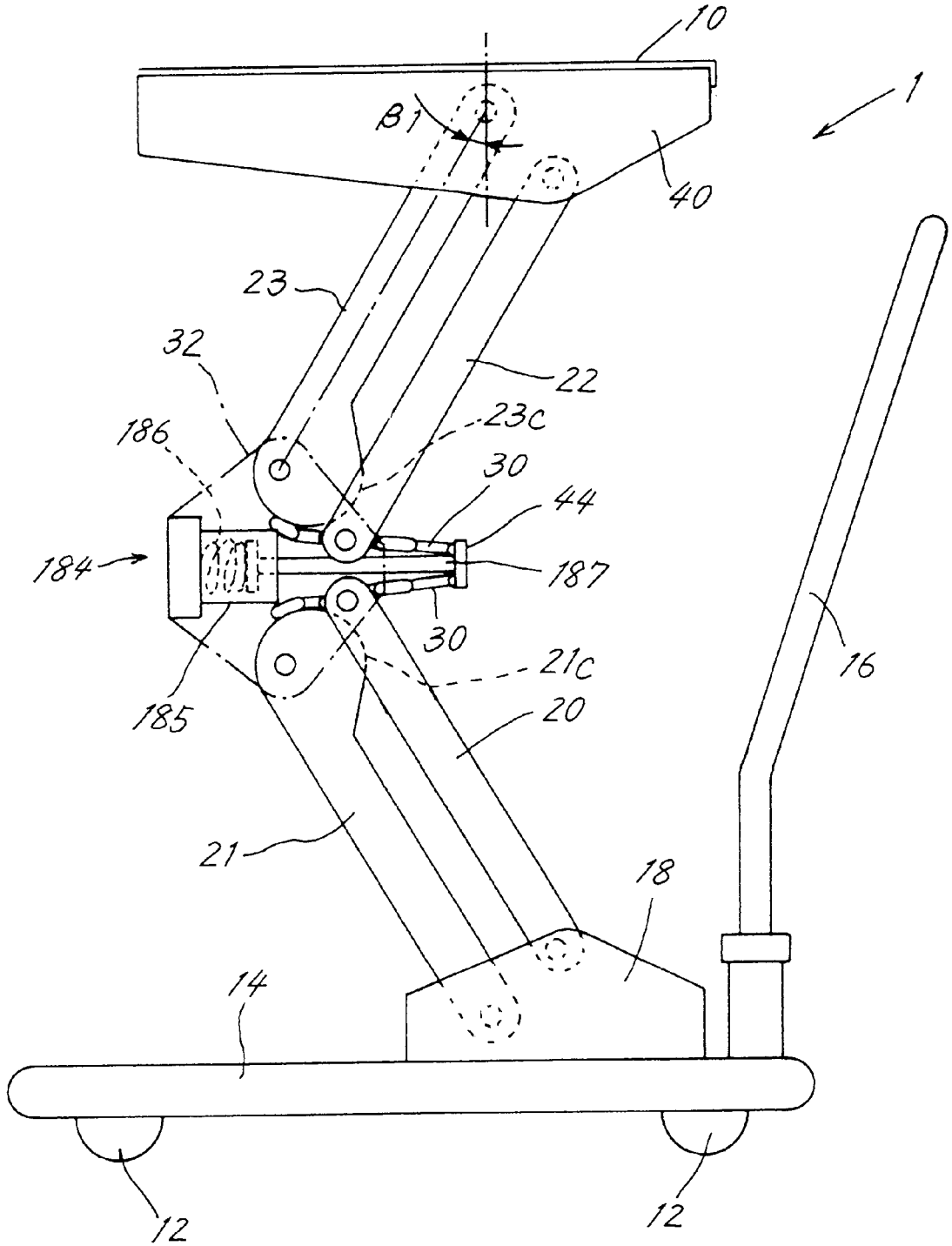
FIG. 15 is a side elevation of a work table of the invention as unloaded.

The foregoing hydraulic cylinder unit serving as lift control means for use in the lift mechanism of the invention is replaced by an assembly which, as seen in FIG. 15, comprises a cylindrical body 185 and a push rod 187 movable inwardly and outwardly of the body 185 orthogonal to the direction of lift of a table and biased outward by a compression spring 186 provided inside the body 185, whereby the lift mechanism is adapted for use as a work table.

The push rod 187 is provided at its outer end with a mount plate 44, and chains 30, 30 serving as traction members are attached, each at its one end, to the upper and lower portions of the plate 44. The upper chain 30 is connected to the lower end of an upper drive arm 23. The lower chain 30 is connected to the upper end of a lower drive arm 21.

Figure 17:
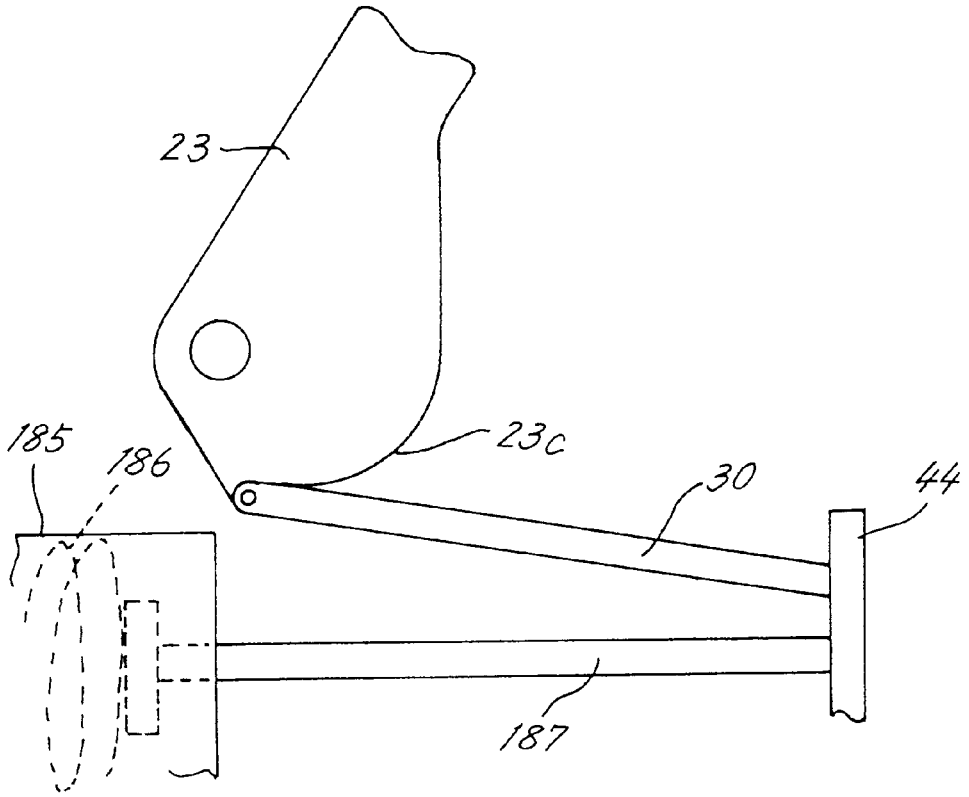
FIG. 17 is a diagram for illustrating a cam face when the table is not loaded.

As shown in FIG. 17, the upper drive arm 23 has a lower end face in the form of a cam face 23*c* for permitting the chain 30 to reeve therearound. The cam face 23*c* comprises a circular-arc face extending from the chain connecting portion toward the direction in which the chain reeves around the arm while bulging with a gradually increasing radius of curvature, and a slope extending straight from the terminal end of the circular-arc face. Similarly, the lower drive arm 21 has an upper end providing a cam face 21*c*.

[Lifting-Lowering Operation]

Figure 16:
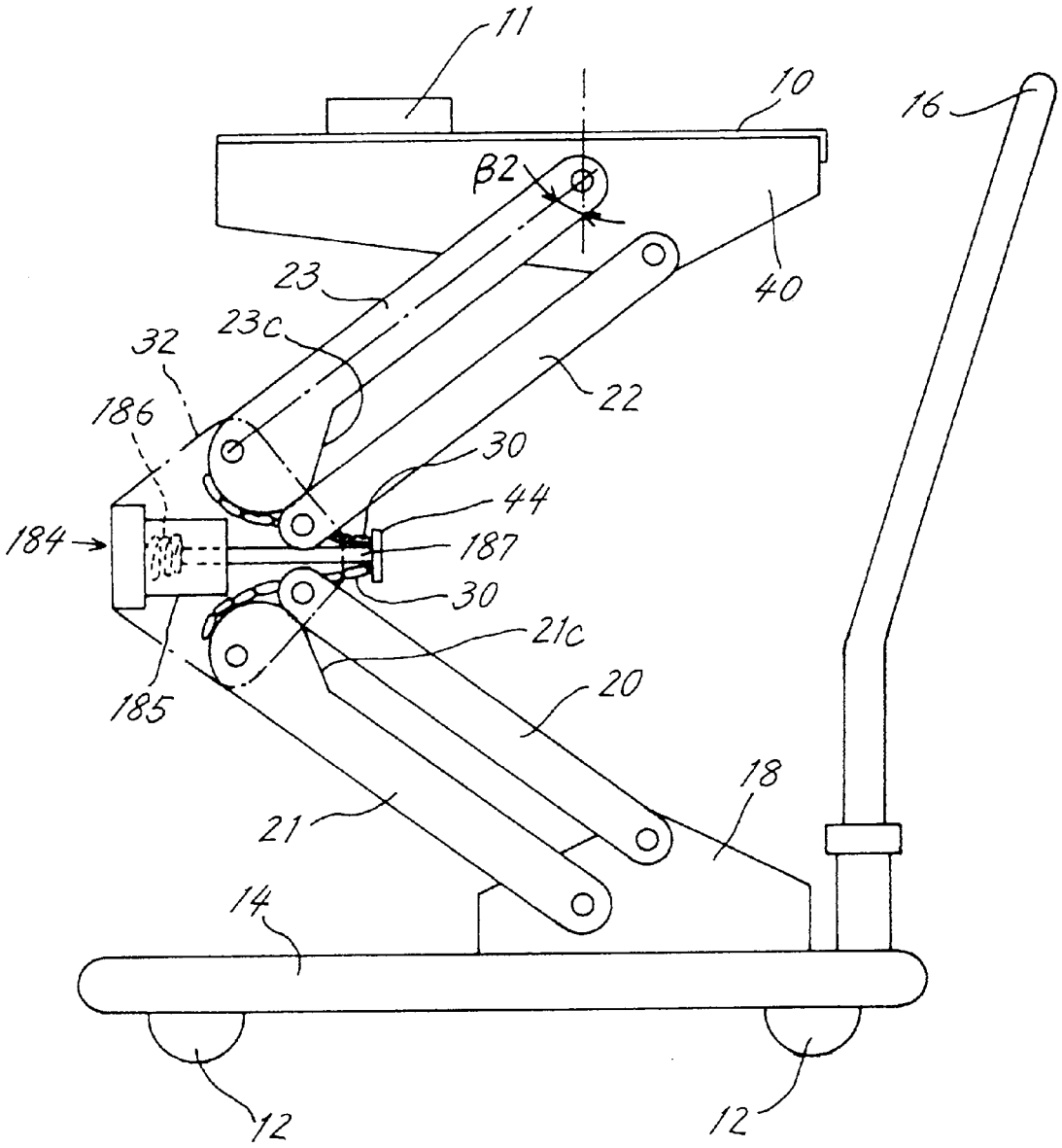
FIG. 16 is a side elevation of the work table as loaded.

With reference to FIG. 16, when the table 10 is subjected to a downward load by placing an article 11 thereon, an intermediate bracket 32 moves left toward by being pushed by the upper arms 22, 23. The pair of upper arms 22, 23 and the pair of lower arms 20, 21 move in directions opposite to each other about their pivots on the intermediate bracket 32 to lower the table 10.

At this time, the upper drive arm 23 carrying the chain 30 rotates in the direction in which the chain 30 reeves around the cam face 23*c*. The chain 30 is pulled to push in the push rod 187, which in turn is subjected to an elastic repulsive force by the compression spring 186 within the cylindrical body 185. The repulsive force is transmitted to the upper drive arm 23 through the chain 30, whereby the table 10 is given an upward moment and limited in the amount of descent. Thus, when the table 10 is loaded, the moment corresponding to the load is given to the push rod 187, with the result that the table 10 is lowered by an approximately definite amount. Similarly, the lower drive arm 21 also rotates like the upper arm 23 to pull the corresponding chain 30.

When a load is further placed on the table 10 as lowered by the load already applied thereto, the angle $\beta 2$ the upper drive arm 23 makes with a vertical line as seen in FIG. 16 is greater than the angle $\beta 1$ in the unloaded state (see FIG. 15). The moment M applied to the pivot of the upper drive arm 23 by the load on the table 10 is a value obtained by multiplying the load by sin $\beta 2$ and multiplying the resulting product by the length of the upper drive arm 23. Accordingly, in cases which are equal in the sum of load values applied, the moment M is greater to result in a greater descent of the table 10 if an additional load is placed on the table 10 as lowered in advance.

Figure 18:
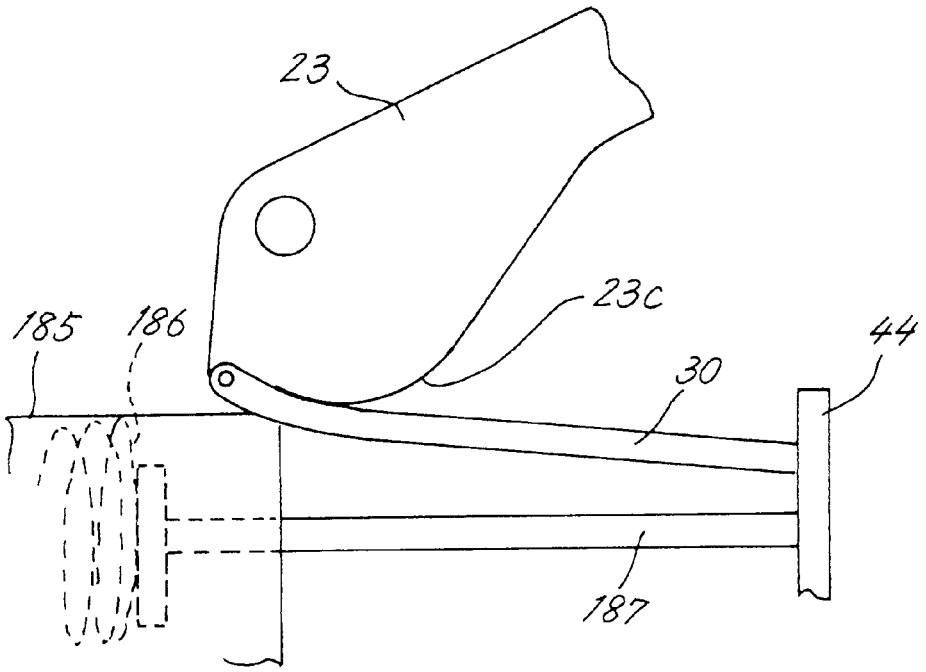
FIG. 18 is a diagram for illustrating the cam face when the table is loaded.

With the work table of the present embodiment, the chains 30, 30 reeve around the cam faces 23*c*, 21*c* of the upper and lower drive arms 23, 21 as shown in FIG. 18, so that the greater the angle of rotation of the upper drive arm 23, the greater is the amount of pull on the chain 30. This causes the push rod 187 to be pushed in by a greater amount to increase the elastic force of the compression spring 186 within the cylindrical body 185, consequently giving an increased upward moment to the table 10. As a result, even if the moment M becomes greater by the additional load, the moment afforded by the push rod 187 also increases, so that the overall moment given to the pivot of the upper drive arm 23 remains almost unaltered. Thus, when a load is applied to the table 10, the table descends at constant rate regardless of the initial level of the table.

While the table descends at a constant rate when loaded regardless of the initial level of the table, the table ascends also at a constant rate when the table is gradually unloaded regardless of the initial level of the table.

The foregoing description of the embodiments is given for illustrating the present invention and should not be construed as limiting the invention set forth in the appended claims. The device or mechanism of the invention is not limited to the above embodiments in construction but can of course be modified variously within the technical scope as set forth in the claims.

What is claimed is:

1. A lift mechanism comprising:

a lower bracket to be attached to a base;

a lower support arm pivoted at one end thereof to the lower bracket to form a first pivot of the lower support arm, and a lower drive arm pivoted at one end thereof to the lower bracket to form a first pivot of the lower drive arm positioned obliquely downward from the first pivot of the lower support arm;

an intermediate bracket for pivotally supporting free ends of the lower support arm at a second pivot of the lower support arm and the lower drive arm at a second pivot of the lower drive arm, wherein the distance between the first pivots of the lower arms is equal to the distance between the second pivots of the lower arms with the arms in parallel to each other;

lift control means disposed on the intermediate bracket and having a movable member retractably projectable in a longitudinal direction parallel to the base;

an upper support arm and an upper drive arm pivoted each at one end thereof to the intermediate bracket to form a first pivot of the upper support arm and a first pivot of the upper drive arm, the first pivots being respectively symmetric about the lift control means with the second pivot of the lower support arm and the second pivot of the lower drive arm;

an upper bracket for pivotally supporting the other ends of the upper support arm at a second pivot of the upper support arm and the upper drive arm at a second pivot of the upper drive arm, wherein the distance between the first pivots of the upper arms is equal to the distance between the second pivots of the upper arms with the upper arms in parallel to each other; and traction members attached each at one end thereof to an outer end of the movable member of the lift control means and connected at the other ends thereof to respective mount portions formed on the lower drive arm and the upper drive arm at their ends pivoted to the intermediate bracket.

2. The lift mechanism as defined in claim 1 wherein the lift control means is a hydraulic cylinder unit having a movable piston rod, and the lower and upper drive arms are raised or caused to fall down by the projection or retraction of the piston rod.

3. A table lift device comprising a lift mechanism as defined in claim 2, the lower bracket being attached to the base, the upper bracket being attached to a table.

4. A table tilt-lift device comprising first and second lift mechanisms mounted on a base, each of the lift mechanisms being a lift mechanism as defined in claim 2, and a table pivoted to upper portions of the upper brackets of the first and second lift mechanisms, the lower bracket of the first lift mechanism being fixed to the base, the lower bracket of the second lift mechanism being attached to the base and pivotally movable in a vertical plane.

5. A table tilt-lift device comprising first and second lift mechanisms mounted on a base, each of the lift mechanisms being a lift mechanism as defined in claim 2, and a table disposed on upper portions of the upper brackets of the first and second lift mechanisms, the lower brackets of the first and second lift mechanisms being fixed to the base, the upper bracket of the first lift mechanism being movable toward and away from the upper bracket of the second lift mechanism, the upper bracket of the second lift mechanism being pivoted at a fixed position to the table.

6. The lift mechanism as defined in claim 1 wherein a phantom line through the first pivot of the lower support arm and the first pivot of the lower drive arm on the lower bracket makes an angle of 45 degrees with the base.

7. The lift mechanism as defined in claim 1 wherein the lower drive arm and the upper drive arm are formed with respective cam faces extending from the mount portions toward respective directions of rise for the lower and upper drive arms for permitting the respective traction members to come into contact with, the cam faces having an approximately circular-arc form, the circular-arc faces being so shaped as to be a greater distance away from the pivots of the drive arms on the intermediate bracket as they extend from the mount portions and as to permit the traction members to be positioned in parallel to the base when the lower drive arm is parallel to the base.

8. A table lift device comprising a lift mechanism as defined in claim 1, the lower bracket being attached to the base, the upper bracket being attached to a table.

9. The table lift device as defined in claim 8 wherein the lift control means comprises a cylindrical body and a movable push rod partly inserted in the cylindrical body and biased outward by a spring, and the arms are raised and caused to fall down in accordance with the weight of an article placed on the table.

* * * * *

UNITED STATES PATENT AND TRADEMARK OFFICE

CERTIFICATE OF CORRECTION

PATENT NO. : 6,029,585
DATED : February 29, 2000
INVENTOR(S) : Yoshikazu Tabayashi It is certified that error appears in the above-identified patent and that said Letters Patent is hereby corrected as shown below:

Column 2,
Line 37, "low" should be -- lowered --.
Line 51, after "showing" insert -- a --.
Line 63, "lover" should be -- lower --.

Column 3,
Line 35, remove "-" after "through".

Column 7,
Line 27, "mechanism" should read -- mechanisms --.

Column 11,
Line 33, "left toward" should read -- leftward --.

Column 14,
Line 17, "8" should read -- 3 --.

Signed and Sealed this

Fifth Day of March, 2002

*Attest:*

*Attesting Officer*

JAMES E. ROGAN
*Director of the United States Patent and Trademark Office*